US006170466B1

(12) United States Patent
Klinger et al.

(10) Patent No.: US 6,170,466 B1
(45) Date of Patent: Jan. 9, 2001

(54) QUANTITY CONTROL VALVE FOR A FUEL INJECTION SYSTEM

(75) Inventors: Horst Klinger, Ludwigsburg; Uwe Kuhn, Riederich; Bernd Rosenau, Tamm; Peter Traub, Stuttgart; Thomas Goettel, Schwaikheim; Gerd Loesch, Stuttgart; Sandro Soccol, Bietigheim-Bissingen, all of (DE); Regis Blanc, Lyons; Francois Rossignol, Mornant, both of (FR); Mathias Schumacher, Asperg (DE); Andre Fromentoux, St. Pierre de Chandieu (FR)

(73) Assignee: Robert Bosch GmbH, Stuttgart (DE)

( * ) Notice: Under 35 U.S.C. 154(b), the term of this patent shall be extended for 0 days.

(21) Appl. No.: 09/098,745

(22) Filed: Jun. 17, 1998

(30) Foreign Application Priority Data

Jun. 17, 1997 (DE) ..... 197 25 474

(51) Int. Cl.[7] ..... F02M 37/04
(52) U.S. Cl. ..... 123/458; 123/462
(58) Field of Search ..... 123/510, 458, 123/382, 383, 457, 463, 462

(56) References Cited

U.S. PATENT DOCUMENTS

| | | | | |
|---|---|---|---|---|
| 2,995,898 | * | 8/1961 | Thorner | 123/385 |
| 4,660,522 | * | 4/1987 | Babitzka | 123/458 |
| 4,869,219 | * | 9/1989 | Bremmer | 123/383 |
| 5,092,299 | * | 3/1992 | Muntean | 123/383 |
| 5,884,606 | * | 3/1999 | Kellner | 123/458 |
| 5,996,557 | * | 12/1999 | Muraki | 123/458 |

FOREIGN PATENT DOCUMENTS

| | | |
|---|---|---|
| 299337 | 1/1989 | (EP) . |
| 2132700 | 7/1984 | (GB) . |
| 2216632 | 10/1989 | (GB) . |
| WO97/24526 | 7/1997 | (WO) . |

* cited by examiner

*Primary Examiner*—Carl S. Miller
(74) *Attorney, Agent, or Firm*—Ronald E. Greigg; Edwin E. Greigg

(57) ABSTRACT

The invention relates to a quantity control valve for a fuel injection system, used in internal combustion engines, which includes a longitudinal slide that is movable in a valve housing between a first and a second control chamber and that allocates the fuel, flowing in from at least one low-pressure pump, to at least one high-pressure pump. For driving the longitudinal slide, the inflowing fuel is delivered into the first control chamber via a throttle or baffle valve, past the longitudinal slide. In the second control chamber, there is either a restoring spring that urges the longitudinal slide in the direction of its closing position, or the longitudinal slide there has an effective face-end surface area upstream of which a control line containing a throttle valve ends; this end face is smaller in surface area than the effective surface area of the face end in the first control chamber. In the closing position, the longitudinal slide blocks off the outlet bore with one of its cylindrical guide portions, while with regard to the inlet bore it has a narrowed region, which opposite the longitudinal slide bore leaves a flow cross section open that changes gradually to zero in the direction of the guide portion. In the valve, the flow of fuel is controlled by a targeted manipulation of a cross section via a long slide stroke.

13 Claims, 2 Drawing Sheets

QUANTITY CONTROL VALVE FOR A FUEL INJECTION SYSTEM

BACKGROUND OF THE INVENTION

The invention is based on a quantity control valve for a fuel injection system, used in internal combustion engines.

From German Patent Disclosure DE 195 49 108.4, which was not published prior to the filing date of the present application, among other elements a quantity control valve is disclosed that has a longitudinal slide which is movable in a valve housing between a restoring spring chamber and the control chamber and which opens counter to the action of a restoring spring. The hollow longitudinal slide is subjected to fuel from a low-pressure pump via the restoring spring chamber. The fuel enters the control chamber through a throttle restriction located in the longitudinal slide. As soon as the fuel pressure in the control chamber exceeds a certain value, the longitudinal slide opens counter to the action of the restoring spring, and as a result the fuel passes through the longitudinal slide to reach the high-pressure pump via an uncovered outlet bore. The opening of the valve is additionally reinforced with the aid of an electromagnetic drive acting directly on the longitudinal slide.

OBJECT AND SUMMARY OF THE INVENTION

The quantity control valve according to the invention allocates the fuel, flowing in from at least one low-pressure pump, to at least one high-pressure pump. For driving the longitudinal slide, the inflowing fuel is delivered into the first control chamber via a throttle or baffle valve, past the longitudinal slide. In the second control chamber, there is either a restoring spring that urges the longitudinal slide in the direction of its closing position, or the longitudinal slide there has an effective face-end surface area upstream of which a control line containing a throttle valve ends; the surface area of this end face is smaller than the effective surface area of the face end in the first control chamber. In the closing position, the longitudinal slide blocks off the outlet bore with one of its cylindrical guide portions, while with regard to the inlet bore it has a narrowed region, which opposite the longitudinal slide bore leaves a flow cross section open that changes gradually to zero in the direction of the guide portion.

This quantity control valve requires no external electromechanical drive. The drive of the longitudinal slide is effected solely via the fuel pumped by the upstream low-pressure pump. In the valve, the flow of fuel is controlled by a targeted manipulation of cross section via a long slide stroke. Because of the long opening stroke of the longitudinal slide in conjunction with the hydraulically favorably designed contour in the constricted region, the fuel flow can be controlled sensitively with only slight flow losses.

The opening stroke of the longitudinal slide associated with a variation of the flow cross section is at least twice as long as twice the diameter of the outlet bore. In the event that the outlet bore does not have a circular cross section, the theoretical diameter resulting from the cross-sectional area—regardless of its peripheral outline—is defined as the reference dimension.

With one quantity control valve, a plurality of high-pressure pumps can be supplied independently of one another.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
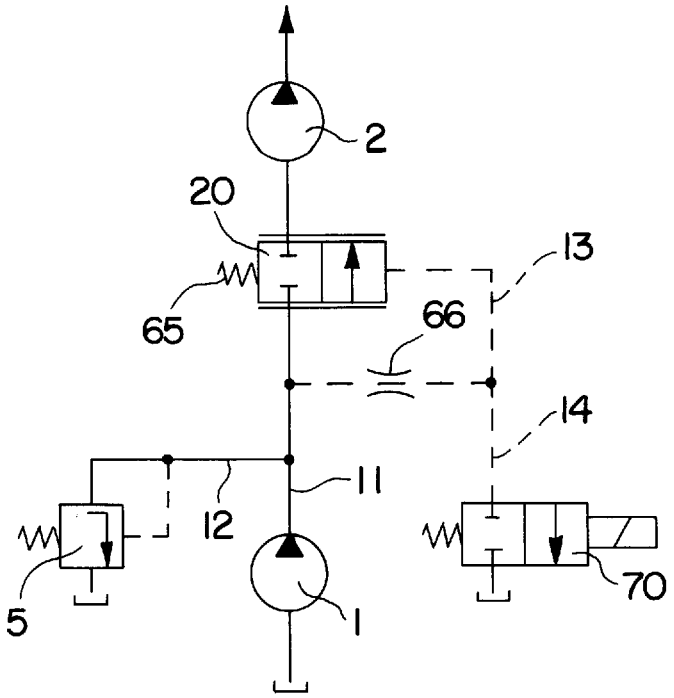
FIG. 1 is a hydraulic circuit diagram for a quantity control valve, which is loaded by a restoring spring, and the circuitry of this valve.
Figure 2:
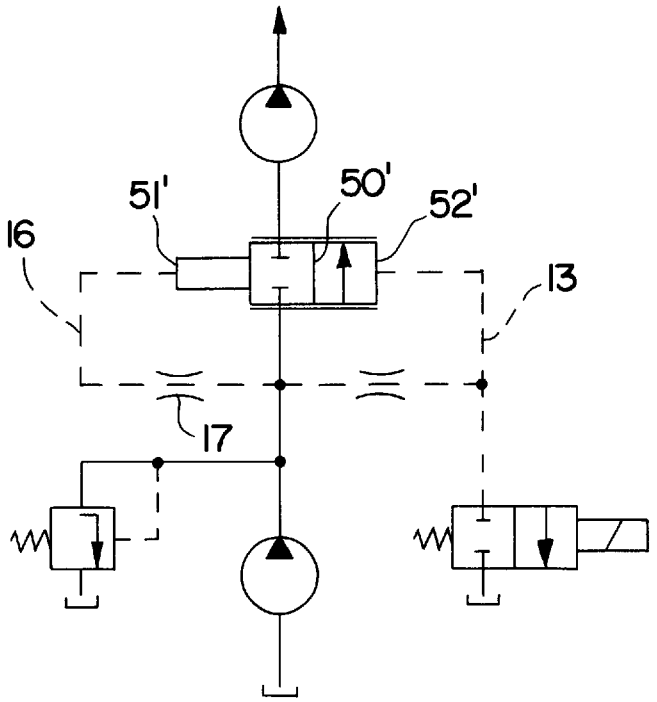
FIG. 2 is a diagram like FIG. 1 but with a slide loaded hydraulically on both ends.

In FIGS. 1 and 2, a 2/2-way gradual multiposition valve 20 is located between a low-pressure pump 1 and a high-pressure pump 2 and meters the fuel supply quantity furnished by the low-pressure pump 1 in accordance with the slide position of valve 20. From an inlet line 11, downstream of the low-pressure pump 1, a return line 12 branches off and leads to a pressure limiting valve 5. This latter valve limits the supply pressure of the low-pressure pump 1 to a predetermined level.

The 2/2-way gradual multiposition valve 20 has two terminal positions, that is, a blocking position and an open position, between which the slide of the valve itself can assume arbitrary intermediate positions for throttling the fuel flow. To that end, a restoring spring 65 that urges the slide into the closing position acts on one end of the slide, while a control pressure is applied to its other side via a control line 13, the control pressure being throttled with the aid of a throttle valve 66 disposed in a line connected with this control line 13. From the control line 13, a relief line 14 branches off between the throttle valve 66 and the 2/2-way gradual multiposition valve 20; via an electromagnetically actuated 2/2-way valve 70, the relief line discharges into the return. The 2/2-way valve 70 has one blocking and one open position, by way of example, and in the state in which it is without electrical current it is held in the blocking position via a restoring spring. Optionally, the flow through the valve can also be controlled in proportion to the valve stroke.

As the supply pressure of the low-pressure pump 1 increases, the 2/2-way gradual multiposition valve 20 increasingly opens, as long as the control pressure in the control line 13 downstream of the throttle valve 66 is not relieved via the 2/2-way valve 70.

In the circuit diagram of FIG. 2, the restoring spring 65 of the 2/2-way gradual multiposition valve 20 is replaced by a control line 16 with an integrated throttle valve 17. At the same time, the effective surface area of the end face 51' of the control slide 50' located upstream of the control line 16 is reduced compared with the end face 52' upstream of the control line 13, so that now the 2/2-way gradual multiposition valve 20 is actuated by differential pressure, at least when the 2/2-way valve 70 is closed.

In this variant, the valve design is simpler, since the restoring spring 66 and its adjusting and fastening means are omitted. The demands made of the electromagnetic actuation of the 2/2-way valve 70 are also less.

Figure 3:
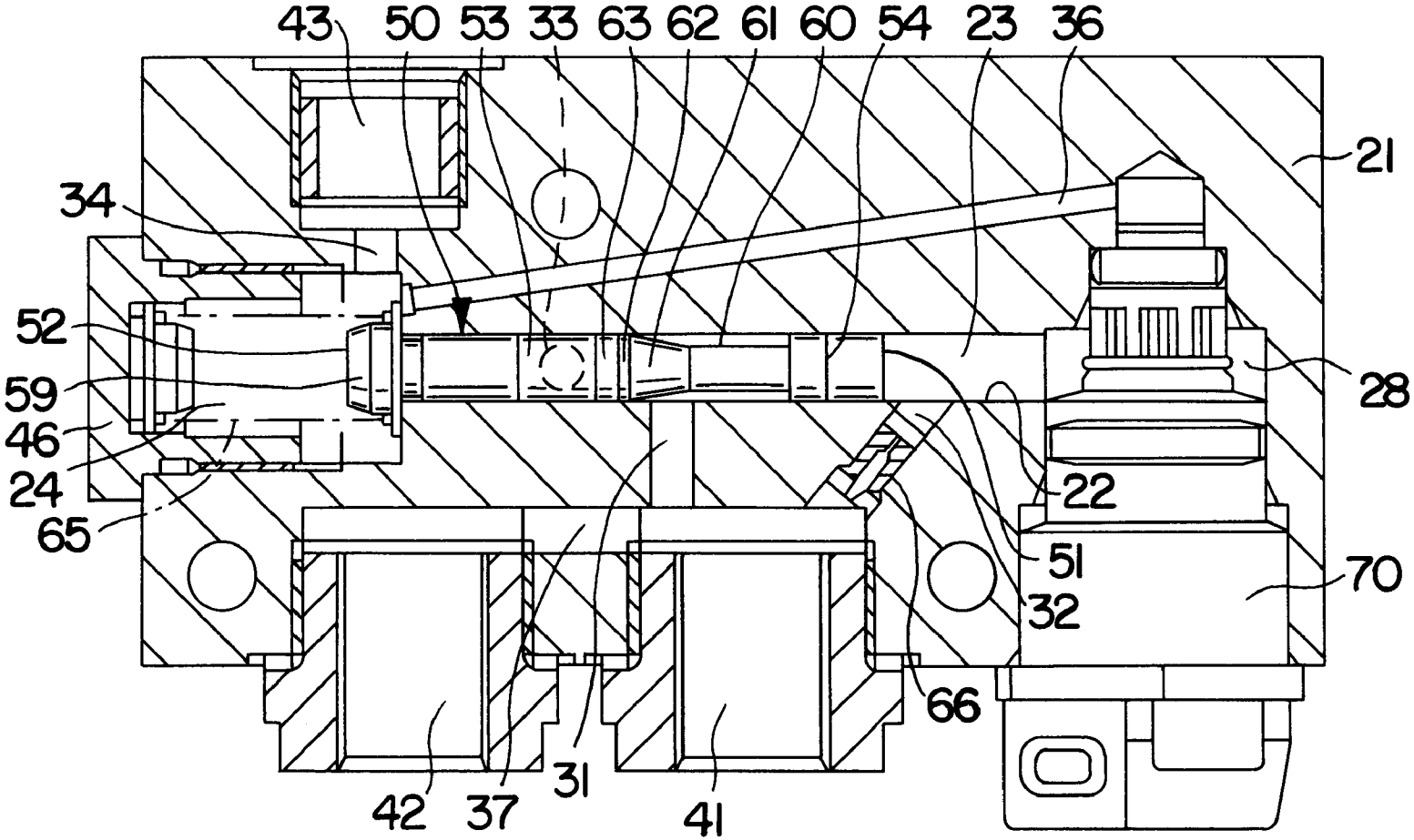
FIG. 3 shows the valves accommodated in a valve housing.

FIG. 3 shows a valve housing 21 with a central bore 22, which receives a longitudinal slide 50 and into which among other elements an inlet bore 31, an outlet bore 33, and a control bore 32 discharge. An inlet connection 41 and a return flow connection 42 are disposed side by side upstream of the inlet bore 31 and the control bore 32. Both connections 41 and 42 communicate with one another inside the valve housing 21 via the conduit 37. The inlet line 11 of FIG. 1 is connected to the inlet connection 41. The return line 12 is connected to the return connection 42.

The throttle valve 66 is seated in the control bore 32, which corresponds to the control line 13 in FIG. 1. By way of example, the throttle valve is embodied as a screw with a central throttle bore. The control bore 32 discharges into the control chamber 23, into which a seat bore 28 also protrudes; a magnet valve 70 is screwed into the seat bore.

The magnet valve 70 is the 2/2-way valve of FIG. 1. The bottom of the seat bore 28 communicates with the other control chamber 24 via a connecting bore 36. From the control chamber 24, a return bore 34 branches off and ends in the valve housing 21 in a return connection 43. From this connection, the relief line 14 from FIG. 1 optionally leads into the tank.

The restoring spring 65, which supports the longitudinal slide 50 via a screwed-in housing cap 46 in the valve housing 21, is disposed in the control chamber 24.

In the exemplary embodiment, the longitudinal slide 50 has a substantially cylindrical shaft, which in the control chamber 24 ends in a head 59 of widened diameter, on which head the restoring spring 65 rests. The shaft has two cylindrical guide regions 53 and 54, which rest, sliding tightly, in the central bore. In the blocking position of the valve 20, the guide regions 53, 54 are located on opposite sides of the inlet bore 31, with the guide region 53 blocking off the outlet bore 33. Between the two guide regions 53, 54, the longitudinal slide 50 is embodied in the form of an annular groove. The annular groove 60 is embodied cylindrically via a partial region adjoining the guide region 54. In this cylindrical region, the longitudinal slide 50 has its minimum diameter. This cylindrical region is adjoined by frustoconical portions 61–63, for instance three in number, which are located side by side, each frustoconical portion having a different cone angle. The first portion 61 here has the smallest cone angle, while the third portion has the largest cone angle. This portion 63 is nearly cylindrical. Because of the contour of the annular groove 60, the hydraulic communication between the inlet bore 31 and the outlet bore 33 is opened with considerable throttling. It is understood that still other contours may also be chosen, so that the throttling may optionally be linear or progressive with regard to the stroke. It is also possible, for the sake of better flow guidance, for the contour course between the guide portion 53 and the location of the smallest longitudinal slide cross section to be smoothed and embodied with gradual transitions. The throttling action can also be varied by manipulating the orifice of the outlet bore 33 into the central bore 22, for instance by means of a suitable notch.

In the view of FIG. 3, the longitudinal slide 50 is shown in a blocking position. No fuel is pumped to the high-pressure pump. If the longitudinal slide 50 is opened completely, counter to the action of the restoring spring, then the maximum volumetric flow flows through the inlet and outlet bores 31, 32. This volumetric flow is a function of the inlet pressure of the fuel pumped by the low-pressure pump 1, of the bore cross sections of the bores 31, 32, and of the flow cross section in the annular groove 60 of the longitudinal slide 50.

When the magnet valve 70 is closed, the quantity control valve opens as soon as a pressure has built up in the control chamber 23, as a result of the fuel flowing via the throttle valve 66, which pressure multiplied by the effective end face 51 results in a force that is greater than the spring force of the restoring spring 65. The spring rate may have a linear, progressive or degressive characteristic curve here. The fuel pressure in the control chamber 23 is regulated by the magnet valve 70.

The throttle valve 66 may also be embodied in the form of a notch, a flattened face, or the like in the guide region 54 of the longitudinal slide 50.

The foregoing relates to a preferred exemplary embodiment of the invention, it being understood that other variants and embodiments thereof are possible within the spirit and scope of the invention, the latter being defined by the appended claims.

We claim:

1. A quantity control valve for delivering fuel from a low-pressure source to a high-pressure pump that is used to supply a high-pressure fuel of a fuel injection system for internal combustion engines, comprising a valve member (50), which is adjustable as a function of operating parameters, characterized in that as the valve member, a control slide (50) is used, which is displacement disposed in a slide bore (22) and has an annular groove (60) define by two piston regions (53, 54), the groove can be made to communicate with the low-pressure source via an inlet (31) and with the high-pressure pump via outlet (26), and the connection cross section to the outlet (33) is varied increasingly with the displacement of the control slide (50) by means of a control contour having three different continuous conical faces adjoining one piston region (53, 54) on a side toward the annular groove (60), the conical face control contour comprises a plurality of cones merging with one another, having different cone angles and/or cylindrical parts, in the slide bore (22), the control slide with one face end (51) defines a control chamber (23), in which a control pressure prevails that acts counter to a restoring force and is variable as a function of operating parameters, and in order to control the control pressure, the control chamber (23) communicates constantly via a throttle (66) with a first pressure region, and is made to communicate with a second pressure region, the second pressure region has a pressure level different from the pressure level of the first pressure region, via an outlet opening (35) controlled by an electrically controlled valve (70) as a function of operating parameters.

2. A quantity control valve in accordance with claim 1 in which the cross section of the outlet (33) has a cross section that deviates from the circular form.

3. A quantity control valve in accordance with claim 1, in which the control slide is displaceable by an electrically driven control motor counter to a force of a spring (65).

4. A quantity control valve in accordance with claim 3, in which the control motor in embodied as a control magnet.

5. A quantity control valve in accordance with claim 1, in which the control slide is adjusted by a stepping motor.

6. A quantity control valve in accordance with claim 1, in which, as the restoring force, a spring (65) is provided, which engages the end of the control slide (50) opposite from the control chamber (23).

7. A quantity control valve in accordance with claim 1, in which a force that results from am imposition of a reference pressure on one face end (51, 51'), on a side of the control slide (50, 50') remote from the control chamber acts as the restoring force.

8. A quantity control valve in accordance with claim 7, in which the face end (51') remote from the control chamber has a smaller area than the face end (52') of the control slide (50') which defines the control chamber, and of the aforementioned pressure regions, the pressure region having the higher pressure level acts as the reference pressure.

9. A quantity valve in accordance with claim 3, in which the control slide (50) is displaceable by the spring (65) up to a stop, and in this position the communication-between the annular groove (60) and the outlet (33) is interrupted.

10. A quantity valve in accordance with claim 6, in which the control slide (50) is displaceable by the spring (65) up to a stop, and in this position the communication between the annular groove (60) and the outlet (33) is interrupted.

11. A quantity control valve in accordance with claim 9, in which the inlet (31, 41) communicates constantly with the annular groove (60).

12. A quantity control valve in accordance with claim 1, in which the first pressure region, with which the control pressure chamber (23) communicates is the low-pressure source, and the second pressure region is a relief chamber.

13. A quantity control valve in accordance with claim 6, in which the first pressure region, with which the control pressure chamber (23) communicates is the low-pressure source, and the second pressure region is a relief chamber.

* * * * *